US009169679B2

(12) United States Patent
McAdoo

(10) Patent No.: US 9,169,679 B2
(45) Date of Patent: Oct. 27, 2015

(54) CABINET AND HINGE ASSEMBLY

(71) Applicant: Belden Inc., St. Louis, MO (US)

(72) Inventor: Michael Wray McAdoo, Washington, PA (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 13/793,995

(22) Filed: Mar. 11, 2013

(65) Prior Publication Data

US 2014/0252935 A1 Sep. 11, 2014

(51) Int. Cl.
*E05D 3/02* (2006.01)
*E05D 7/10* (2006.01)

(52) U.S. Cl.
CPC *E05D 3/02* (2013.01); *E05D 7/105* (2013.01); *A47B 2220/0069* (2013.01); *E05Y 2900/208* (2013.01); *Y10T 16/52* (2015.01); *Y10T 16/535* (2015.01)

(58) Field of Classification Search
CPC ..... E05D 7/02; E05D 7/10; E05D 7/1005; E05D 7/1044; E05D 7/105; E05D 5/0215; E05D 5/0223; E05D 5/023
USPC ..... 312/324, 326, 329, 296, 138.1, 405; 16/266, 268; 49/381, 382, 397, 399
See application file for complete search history.

(56) References Cited

U.S. PATENT DOCUMENTS 230,491 A * 7/1880 Peer ..... 16/266
580,448 A * 4/1897 Buchanan ..... 16/266
1,895,466 A 1/1933 Kuntz
2,677,147 A * 5/1954 Phillips ..... 16/266
3,247,312 A * 4/1966 Alessi ..... 174/374
3,431,591 A * 3/1969 Betso ..... 16/265
4,334,338 A * 6/1982 Conn ..... 16/266
4,785,498 A * 11/1988 Brotschi ..... 16/238
4,827,568 A 5/1989 Ramsauer
4,873,745 A * 10/1989 Ramsauer ..... 16/258
4,937,916 A 7/1990 Redman
5,007,134 A * 4/1991 Stanford ..... 16/266
5,150,500 A * 9/1992 Bisbing ..... 16/239
5,232,277 A * 8/1993 Cassady et al. ..... 312/296
5,964,499 A * 10/1999 Carter ..... 296/186.4
6,070,297 A * 6/2000 Borer ..... 16/266

(Continued)

OTHER PUBLICATIONS

Southco 96 Hinge Nov. 2011.pdf, Nov. 25, 2011.*

(Continued)

*Primary Examiner* — Daniel J Troy
*Assistant Examiner* — Andrew Roersma
(74) *Attorney, Agent, or Firm* — Foley & Lardner LLP

(57) ABSTRACT

A storage cabinet includes a frame assembly having a forward facing surface and defining an interior configured to store items; a door assembly having a lateral surface; and a hinge assembly pivotally coupling the frame assembly to the door assembly such that the door assembly is moveable from a closed position to a plurality of open positions. The hinge assembly includes a frame component mounted to the forward facing surface of the frame assembly; and a door component mounted to the lateral surface of the door component and configured to rotate relative to the frame component upon rotation of the door assembly relative to the frame assembly. The hinge assembly is configured to enable a user to remove the door assembly from the frame assembly by lifting the door in a vertical direction only when the door assembly is moved from the closed position at least a predetermined amount.

17 Claims, 5 Drawing Sheets

(56) References Cited

U.S. PATENT DOCUMENTS

| | | | | |
|---|---|---|---|---|
| 6,175,992 | B1 * | 1/2001 | Sauerland | 16/382 |
| 6,434,791 | B1 * | 8/2002 | Chung | 16/387 |
| 6,684,457 | B2 * | 2/2004 | Holt | 16/387 |
| 6,859,980 | B2 * | 3/2005 | Baer | 16/354 |

OTHER PUBLICATIONS

Dirak GMBH, 4-182.05 Hinge Pr05 180°, dated Jun. 2, 2012, 1 page.
Emka Beschlagteile, 180° Hinge Program 1110, available at least as early as Jan. 2013, 1 page.
Southco, 96 Hinge, available at least as early as Jan. 2013, 11 pages.

* cited by examiner

CABINET AND HINGE ASSEMBLY

BACKGROUND

The present disclosure relates generally to the field of cabinet assemblies, and more particularly, to cabinet assemblies usable, for example, as computer server storage cabinets, and having one or more security hinges.

There are many challenges associated with providing hinge assemblies having a robust design and various security features to ensure the security of the contents within, for example, a cabinet or similar enclosure. As such, various embodiments disclosed herein provide for an improved cabinet and/or hinge assembly.

SUMMARY

One embodiment relates to a storage cabinet comprising a frame assembly comprising a forward facing surface and defining an interior configured to store items; a door assembly comprising a lateral surface; and a hinge assembly pivotally coupling the frame assembly to the door assembly such that the door assembly is moveable from a closed position to a plurality of open positions, the hinge assembly comprising a frame component mounted to the forward facing surface of the frame assembly; and a door component mounted to the lateral surface of the door component and configured to rotate relative to the frame component upon rotation of the door assembly relative to the frame assembly; wherein the hinge assembly is configured to enable a user to remove the door assembly from the frame assembly by lifting the door in a vertical direction only when the door assembly is moved from the closed position at least a predetermined amount.

Another embodiment relates to a security hinge assembly configured to couple a cabinet door to a cabinet frame, the hinge assembly comprising a frame component configured to be coupled to the frame, the frame component comprising a main body, an extending portion extending from the main body in a first direction, a security tab extending transversely from the extending portion, and a pivot pin extending from the main body in the first direction; and a door component configured to be coupled to the door, the door component comprising a body defining a pivot pin aperture configured to receive the pivot pin, at least a portion of the body configured to be positioned between the main body of the frame component and the security tab of the frame component when the frame component and the door component are in a closed position; wherein the frame component and the door component are configurable in a first configuration wherein the frame component is coupled to a first side of the frame assembly and a second configuration wherein the frame component is coupled to a second side of the frame assembly.

Another embodiment relates to a cabinet assembly comprising a frame; a door; and a hinge pivotally coupling the door to the frame, the hinge comprising a frame component fixedly coupled to the frame; and a door component fixedly coupled to the door and rotatably coupled to the frame component; wherein the hinge is reversible to enable pivotal coupling of the door to opposite sides of the frame; wherein the door component is removable from the frame component in a vertical direction only when the door is opened at least a predetermined amount relative to the frame; and wherein the door is openable to greater than 180 degrees relative to the frame.

DETAILED DESCRIPTION OF EXEMPLARY EMBODIMENTS

Referring to the FIGURES generally, various embodiments disclosed herein are directed to cabinet and/or hinge assemblies that provide various features that are often beneficial to users, particularly in the context of computer server cabinets and similar enclosures. For example, the cabinet assembly illustrated herein may provide a secure environment for computer servers and similar components by way of a security hinge that couples the cabinet door to the cabinet frame. In some embodiments, the security hinge may be a reversible hinge, such that the position of the hinge may be reversed (e.g., from a right-hand opening configuration to a left-hand opening configuration). Furthermore, the security hinges may be installed on, or removed from, a fully loaded cabinet or other enclosure, and enable at least 180 degrees of door swing. Further yet, the door may be liftable off from the frame only after the door has been unlocked and opened at least a certain amount (e.g., at least 35 degrees, etc.), and the hardware used to mount the hinge assembly may be inaccessible while the door is closed. In some embodiments, a continuous seal or gasket may extend about a sealing flange of the door. These and other features of the cabinet assembly and hinge assembly will be described in greater detail below.

Figure 1A:
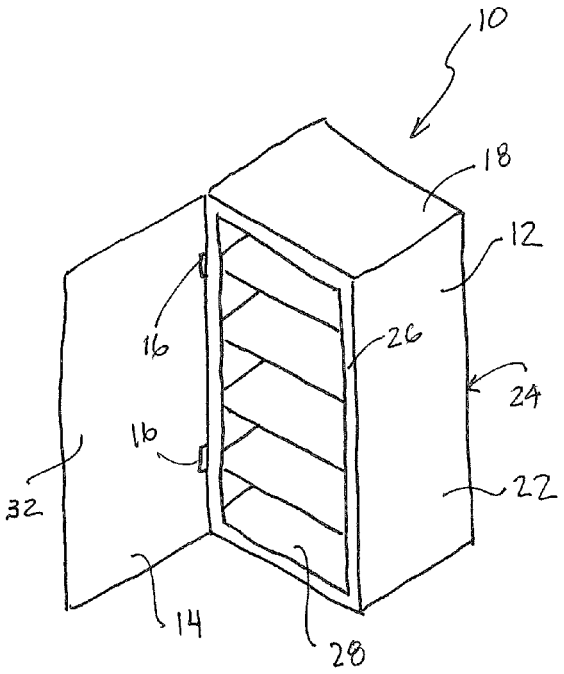
FIG. 1A is a perspective view of a cabinet assembly with a door in an open position according to an exemplary embodiment.
Figure 1B:
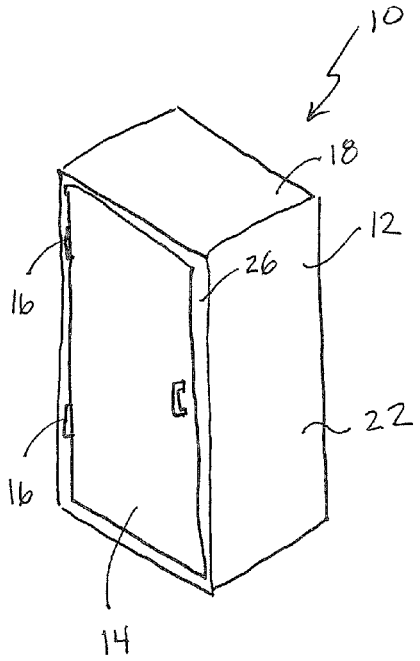
FIG. 1B is a perspective view of the cabinet assembly of FIG. 1A with the door in a closed position according to an exemplary embodiment.

Referring now to FIG. 1, a cabinet assembly 10 (e.g., a server cabinet, an enclosure, storage device, etc.) is shown according to an exemplary embodiment, and includes a frame assembly 12 coupled to a door assembly 14 by way of one or more hinge assemblies 16. In some embodiments, cabinet assembly 10 is configured for use as a computer server cabinet, while in other embodiments, cabinet assembly 10 may be used in a variety of other environments and to store various different items. All such applications are to be understood to be within the scope of the present disclosure.

As shown in FIG. 1, frame 12 includes a top 18, a bottom 20, and a number of sidewalls 22 extending between top 18 and bottom 20. Top 18, Bottom, 20, and sidewalls 22 collectively define an interior of cabinet 10 and frame 12 that may receive one or more shelves 28 usable to hold electronics components or other items. Frame 12 further includes a front flange 26 forming a forward facing surface for frame 12 and a lip 30 (see FIG. 5A).

Figure 5A:
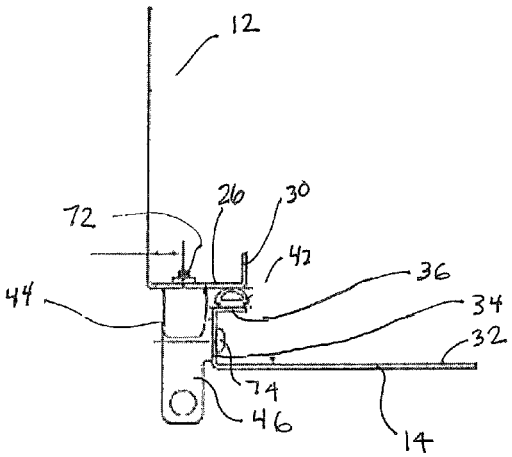
FIG. 5A is a top cross-section view of a portion of the cabinet assembly of FIG. 1A in a closed position according to an exemplary embodiment.

Door 14 includes a main body portion 32 (e.g., a generally flat and/or planar member, etc.) and a flange 34 (e.g., a lateral member or surface) extending in a perpendicular manner along at least one side of main portion 32 (see, e.g. FIG. 5A). A lip 36 may extend transversely relative to and from flange 34 to form an inner facing surface for door 14. Door 14 may include a seal or gasket 42 that extends continuously about lip 36. Seal 42 may provide a continuous sealing surface between frame 12 and door 14 to prevent unwanted moisture, debris, etc. from entering the interior of the cabinet assembly.

Figure 2A:
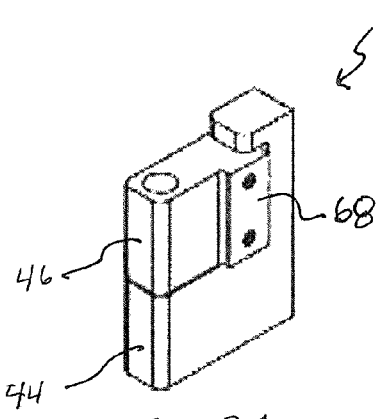
FIG. 2A is a perspective view of a hinge assembly usable with the cabinet assembly of FIG. 1A in a first configuration according to an exemplary embodiment.
Figure 2B:
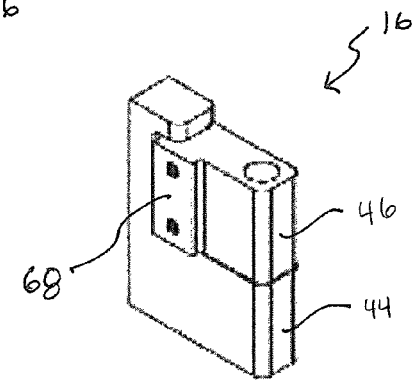
FIG. 2B is a perspective view of the hinge assembly of FIG. 2A usable with the cabinet assembly of FIG. 1A in a second configuration according to an exemplary embodiment.
Figure 2C:
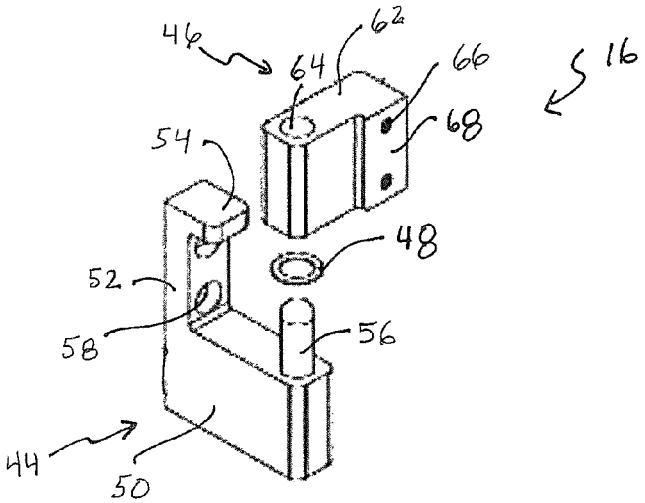
FIG. 2C is an exploded view of the hinge assembly of FIG. 2A according to an exemplary embodiment.

Referring now to FIGS. 2A-4B, hinge assembly 16 is shown in greater detail according to an exemplary embodiment. As shown in FIG. 2A, hinge assembly 16 includes a frame component 44 and a door component 46. Frame component 44 and/or door component 46 may be made of any suitable metal (e.g., steel, etc.) of other material. Hinge assembly 16 may further include a spacer 48 configured to facilitate rotation of frame component 44 relative to door component 46. As shown in FIG. 2C, spacer 48 may be a washer-shaped member and reside between frame component 44 and door component 46. Hinge assembly 16 is configured such that door component 46 is moveable (e.g., rotatable, pivotable, etc.) relative to frame component 44 from a closed position (see, e.g., FIG. 5A) to any of a number of open positions (see, e.g., FIGS. 5B-E, FIG. 6B).

Figure 3A:
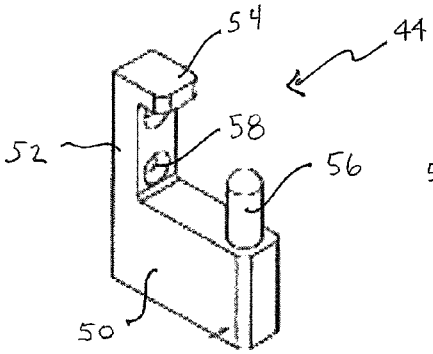
FIG. 3A is a perspective view of a frame component of the hinge assembly of FIG. 2A according to an exemplary embodiment.
Figure 3B:
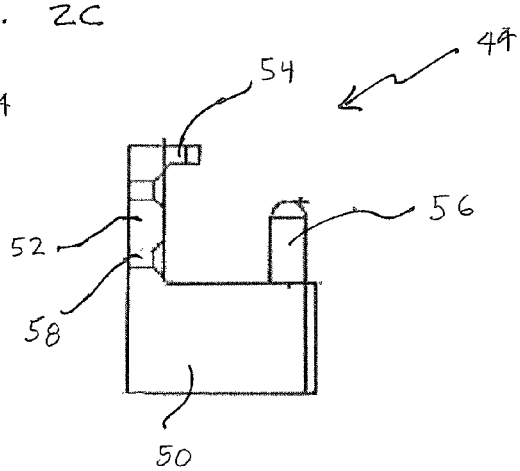
FIG. 3B is a side view of the frame component of FIG. 3A according to an exemplary embodiment.

According to one embodiment, frame component 44 includes a main portion 50, an extending portion 52, and a tab 54 (e.g., a security tab, etc.). A pivot pin 56 extends from main portion 50, and one or more apertures 58 extend through extending portion 52 to facilitate counting of frame component 44 to frame 12. As shown in FIGS. 3A-3B, main portion 50 is generally rectangular in shape, and extending portion 52 is a relatively narrow member extending upward from main portion 50. Tab 54 extends generally transversely relative to extending portion 52 to form a recess into which at least a portion of door component 46 resides when door 14 is closed or in a near-closed position. Frame component 44 further includes a frame mounting surface 68 that engages frame 12 when frame component 44 is mounted to frame 12. In one embodiment surface 68 is configured to engage the forward facing surface of flange 26 when mounted.

Figure 4A:
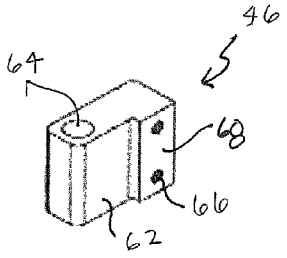
FIG. 4A is a perspective view of a door component of the hinge assembly of FIG. 2A according to an exemplary embodiment.
Figure 4B:
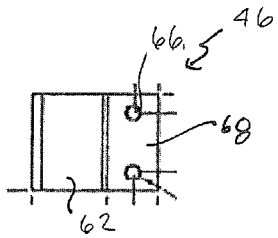
FIG. 4B is a side view of the door component of FIG. 4A according to an exemplary embodiment.

Referring to FIGS. 4A-4B, door component 46 includes a generally rectangular body 62 that defines a pivot pin aperture 64 configured to receive pivot pin 56 of frame component 44 and enable rotation of door component 46 and door 14 relative to frame component 44 and frame 12. One or more fastener apertures 66 extend through body 62 and facilitate mounting of door component 46 to door 14 by way of fasteners 74 (see FIG. 5A). In one embodiment, the height of body 62 generally corresponds to the distance between tab 54 and main portion 50 of frame component 44, such that movement of door component 46 is limited when door 14 is in a closed position. Door component 46 further includes a door mounting surface 68 that engages door 14 when door component is mounted. In one embodiment, door mounting surface 68 is configured to engage flange 34 when mounted.

Referring now to FIGS. 5A-E, hinge assembly 16 is shown in various positions while mounted to frame 12 and door 14. For example, as shown in FIG. 5A, door 14 is shown in a closed position according to an exemplary embodiment, such that seal 42 provides a seal between door 14 and frame 12 (e.g., between lip 36 of door 14 and flange 26 of frame 12). Because in the closed position frame component 44 and door component 46 are generally aligned, fasteners 72 used to secure frame component 44 to frame 12 are inaccessible for removal while door 14 is in the closed position. This may provide added security to cabinet 10 to avoid unwanted tampering with the fasteners securing hinge 16 in place. Furthermore, as shown in FIG. 5A, security tab 54 of frame component 44 extends over door component 46 (e.g., to provide interference in the vertical direction), such that door component 46 (along with door 14) cannot be lifted off from frame component 44 while door 14 is in the closed, or near-closed, position.

Referring further to FIG. 5A, in some embodiments, the configuration of hinge assembly 16 permits installation and/or removal of frame component 44 and/or door component 46 even when the cabinet is fully loaded with equipment. As such, should a user to desire to, for example, reverse door 14 from a left hand door swing to a right hand door swing, the user need not unload anything from the cabinet, but rather simply change the side on which frame component 44 is mounted, and "flip" door component 46 upside-down (see, e.g., FIGS. 2A-2B) relative to frame component 44. In some embodiments, door 14 may be flipped upside down in its entirety to provide for a reverse configuration of cabinet 10 (e.g., without removing door component 46 from door 14).

Figure 5B:
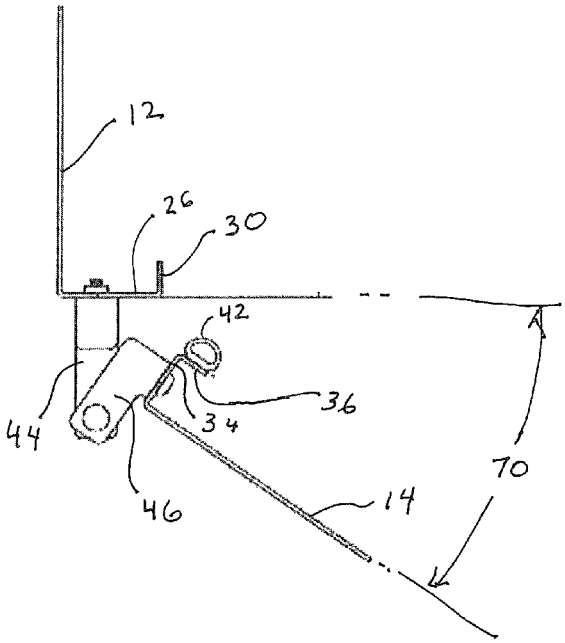
FIG. 5B is a top cross-section view of a portion of the cabinet assembly of FIG. 1A in a first open position according to an exemplary embodiment.

Referring to FIG. 5B, door 14 is shown in a first open position according to an exemplary embodiment. As shown in FIG. 5B, door 14 has been rotated a sufficient amount to an angle 70 to provide vertical clearance between door component 46 and security tab 54, thereby enabling a user to remove door 14 by lifting door 14 in a vertical direction (see also, assembly 116 shown in FIG. 6B). In one embodiment, angle 70 must be at least 35 degrees prior to door 14 being lifted off. In other embodiments, frame component 44 and/or door component 46 may be configured to enable door 14 to be lifted off at other degrees of opening.

Figure 5C:
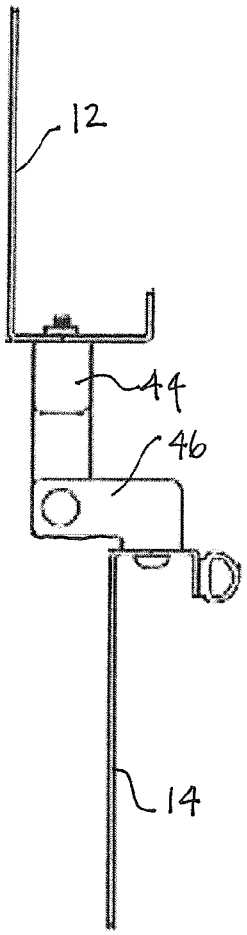
FIG. 5C is a top cross-section view of a portion of the cabinet assembly of FIG. 1A in a second open position according to an exemplary embodiment.
Figure 5D:
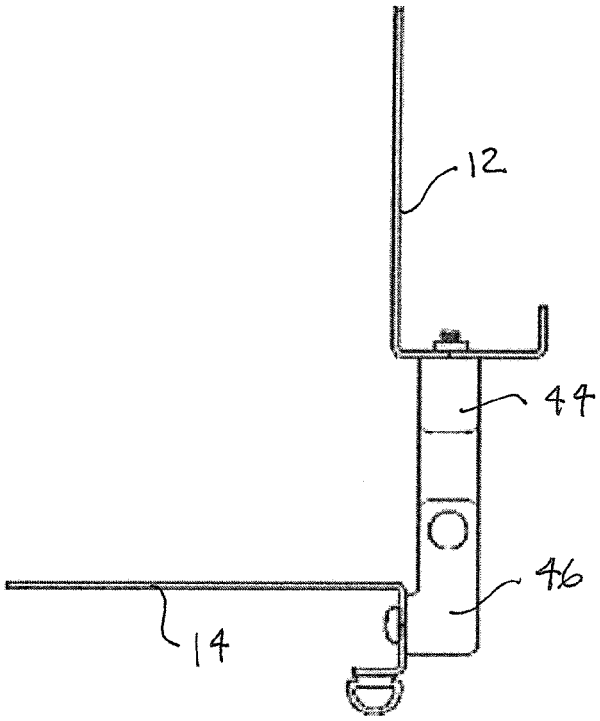
FIG. 5D is a top cross-section view of a portion of the cabinet assembly of FIG. 1A in a third open position according to an exemplary embodiment.
Figure 5E:
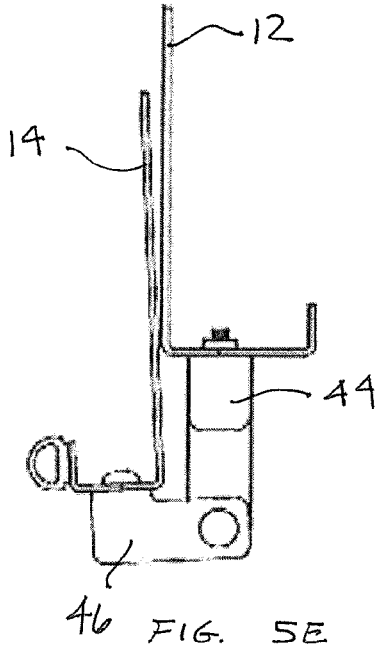
FIG. 5E is a top cross-section view of a portion of the cabinet assembly of FIG. 1A in a fourth open position according to an exemplary embodiment.

Referring to FIG. 5C, door 14 is shown in a second open position according to an exemplary embodiment. As shown in FIG. 5C, door 14 has been rotated approximately 90 degrees, permitting user access to the interior of cabinet 10. Referring to FIG. 5D, door 14 is shown in a third open position of approximately 180 degrees according to an exemplary embodiment (see also assembly 188 shown in FIG. 6B). Referring to FIG. 5E, door 14 is shown in a fourth open position of greater than 180 degrees. In one embodiment, door 14 is openable to at least approximately 260 degrees (or alternatively, at least 265 degrees, at least 267 degrees, or more than 267 degrees), as also shown in assembly 114 shown in FIG. 6B.

It should be noted that in FIGS. 5B-5E, door 14 is shown in various open positions where door 14 can be freely lifted in a vertical direction such that door component 46 can be disengaged from frame component 12 without the need to remove any other hardware, fasteners, retainers, etc., that may be present in more conventional cabinet and hinge designs.

Figures 6A, 6B:
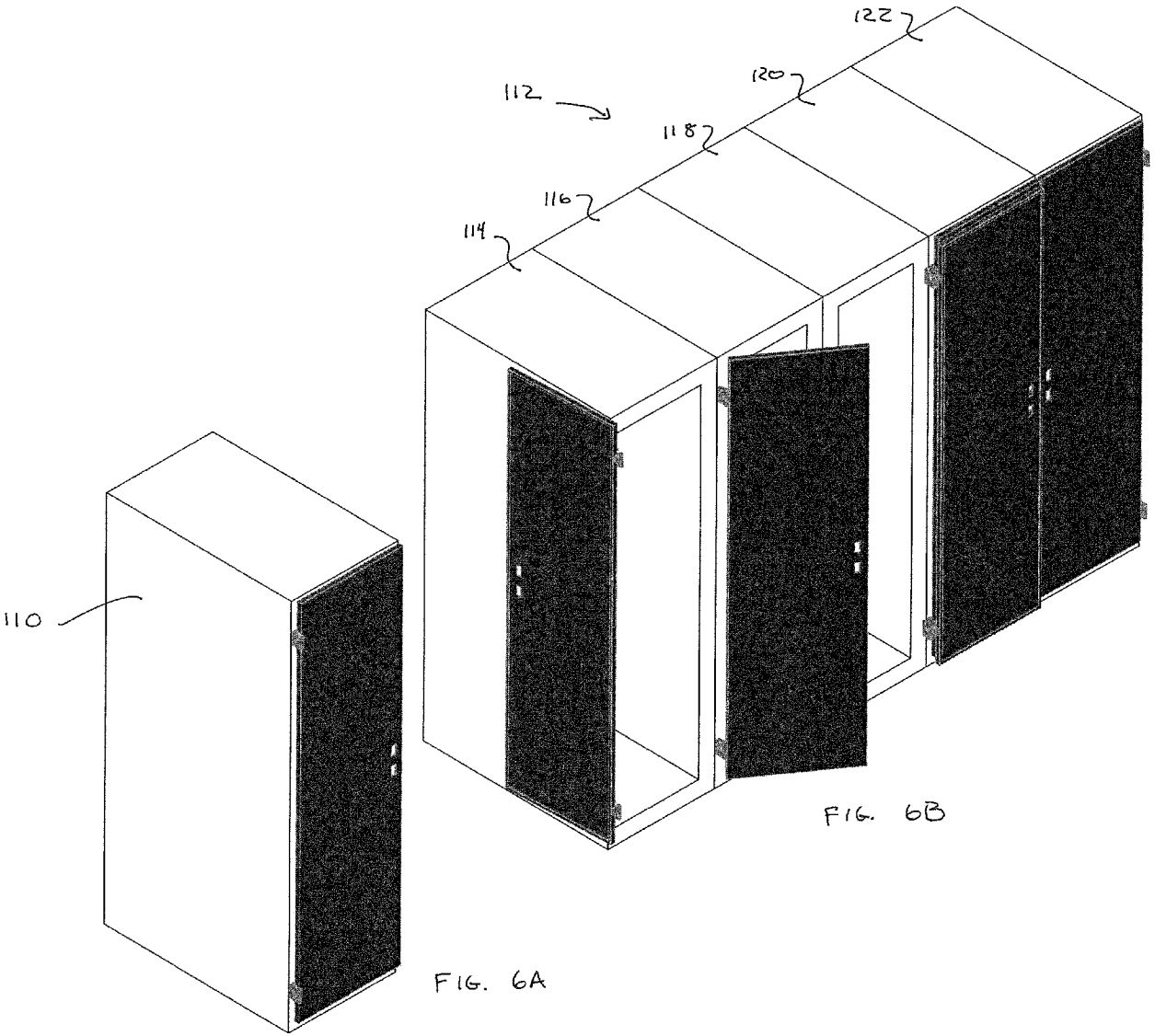
FIG. 6A is a cabinet assembly according to an exemplary embodiment.
FIG. 6B is a bank of adjacent cabinet assemblies according to an exemplary embodiment.

Referring to FIGS. 6A and 6B, a cabinet assembly 110, along with a bank 112 of cabinet assemblies 114-122, are shown according to an exemplary embodiment. Cabinet assemblies 110 and 114-122 are generally similar in structure and function to cabinet assembly 10, and are shown to illustrate various features of the cabinet assembly and how multiple cabinet assemblies may be used together.

As shown in FIG. 6B, multiple cabinet assemblies can be positioned with their sidewalls substantially adjacent to one another due to the face-mounting features of hinge 16. Depending on the configuration (e.g., left or right hand opening, etc.) and position of an assembly within bank 112, the cabinet doors can be opened in differing directions and to varying degrees. For example, cabinet assembly 114 is shown at the end of bank 112, and is in a left hand configuration with the door opened to a maximum extent, which is greater than 180 degrees, and which in some embodiments may be almost 270 degrees. Cabinet assembly 116 is in an intermediate position within bank 112, and is shown in a left hand configuration with the door partially open. For example, the door may be opened a sufficient amount (e.g., 35 degrees) to enable lifting off of the door from the frame.

Referring further to FIG. 6B, cabinet assembly 118 is shown in a right hand configuration with the door open to, for example, approximately 180 degrees, even with another cabinet assembly (cabinet assembly 120) immediately adjacent to the right. Cabinet assembly 120 is shown in another intermediate position within bank 112 in a left hand configuration with the door closed, and cabinet assembly 122 is shown in an end position within bank 112 in a right hand configuration with the door closed.

As can be seen in FIG. 6B, the cabinet assemblies disclosed herein provide various options to users to in terms of configuring individual cabinet assemblies, particularly in the context of a the use of multiple cabinet assemblies in a bank such as bank 112. In addition to those features shown and discussed with respect to FIGS. 6A and 6B, the various cabinet assemblies shown therein may also share any of the features shown and described with respect to cabinet assembly 10. All such features and combinations of features are to understood to be within the scope of the present disclosure.

The hinge assembly disclosed herein may be usable with a wide range of cabinet/enclosure types, sizes, etc., and all such applications are to be understood to be within the scope of the present disclosure. The design of the hinge assembly disclosed herein provides a robust, durable hinge that includes many features not available with more conventional hinge assemblies.

The cabinet assembly and corresponding hinge assemblies shown and described herein may provide various advantages relative to more conventional designs. For example, as illustrated earlier, the hinge assemblies can be face mounted to and removed from a fully loaded enclosure, and may be reversibly mounted to provide for either a right hand door swing or a left hand door swing. Further, the door may rotate more than 180 degrees relative to the frame from the closed position (e.g., up to almost 270 degrees in some applications), and the hinges provide a "lift-off" feature only when the door is opened at least a predetermined amount (e.g., such that the door cannot be lifted off when the door is closed and/or locked). Further yet, the hinges are securely mounted with fasteners that cannot be accessed unless the door is unlocked and open, and the hinges allow for a continuous seal to be applied to the inner surface of the door to prevent the unwanted ingress of debris, moisture, etc.

It should be understood that the construction and arrangement of the elements of the cabinet and hinge assemblies shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. Some like components have been described in the present disclosure using the same reference numerals in different figures. This should not be construed as an implication that these components are identical in all embodiments; various modifications may be made in various different embodiments. It should be noted that the components and/or assemblies of the hinge and cabinet assemblies may be constructed from any of a wide variety of materials that provide sufficient strength or durability, in any of a wide variety of colors, textures, and combinations.

What is claimed is:

1. A storage cabinet comprising:

a frame assembly comprising a forward facing surface and defining an interior configured to store items;

a door assembly comprising a lateral surface;

a hinge assembly pivotally coupling the frame assembly to the door assembly such that the door assembly is moveable from a closed position to a plurality of open positions, the hinge assembly comprising:

a frame component mounted to the forward facing surface of the frame assembly;

a door component mounted to the lateral surface of the door component and configured to rotate relative to the frame component about a pivot axis upon rotation of the door assembly relative to the frame assembly;

wherein the hinge assembly is reversible such that the hinge assembly is usable in both a first configuration on a first side of the frame assembly and a second configuration on a second side of the frame assembly;

wherein the pivot axis is offset a first distance to a front side of the front surface of the frame assembly when the door is in the closed position and wherein the door is offset a second distance to the front side of the front surface of the frame assembly with the door is in the closed position, wherein the first distance in greater than the second distance;

wherein, in both the first configuration and the second configuration, the hinge assembly is configured to enable a user to remove the door assembly from the frame assembly by lifting the door in a vertical direction only when the door assembly is moved from the closed position at least a predetermined amount;

wherein the hinge assembly is visible from an exterior of the storage cabinet when the door assembly is in the closed position; and wherein the frame component comprises a main body portion, an extending portion extending upward from the main body portion, and a security tab extending transversely relative to the extending portion, such that the security tab prevents removal of the door assembly by lifting the door in a vertical direction until the door assembly is moved from the closed position at least the predetermined amount.

2. The cabinet of claim 1, wherein the door component comprises a main body configured to interfere with the security tab and prevent removal of the door assembly by lifting the door in a vertical direction until the door assembly is moved from the closed position at least the predetermined amount.

3. The cabinet of claim 1, wherein the frame component comprises a pivot pin that rotatably receives the door component, and wherein the door component comprises a pivot pin aperture configured to receive the pivot pin.

4. The cabinet of claim 1, wherein the door assembly is rotatable at least 180 degrees from the closed position.

5. The cabinet of claim 1, further comprising a gasket assembly extending about an inner-facing surface of the door assembly.

6. The cabinet of claim 5, wherein the inner-facing surface of the door assembly extends transversely relative to the lateral surface of the door assembly, and wherein the gasket assembly provides a continuous seal about the inner facing surface of the door assembly and between the door assembly and the frame assembly when the door assembly is in the closed position.

7. The cabinet of claim 1, further comprising:

at least one first fastener extending from an exterior of the cabinet and through the frame component to mount the frame component to the frame assembly;

wherein the at least one first fastener is inaccessible for removal when the door assembly is in the closed position.

8. The cabinet of claim 7, further comprising:

at least one second fastener extending through the door component to mount the door component to the door assembly;

wherein the at least one second fastener is inaccessible for removal when the door assembly is in the closed position.

9. The storage cabinet of claim 1, wherein a pivot aperture extends through the door component from a first surface to a second surface, wherein in the first configuration, the first surface faces an upper surface of the frame component, and wherein in the second configuration, the second surface faces the upper surface of the frame component.

10. A security hinge assembly configured to couple a cabinet door to a cabinet frame, the hinge assembly comprising:

a frame component configured to be coupled to the frame, the frame component comprising a main body, an extending portion extending upward from the main body in a first direction, a security tab extending transversely from the extending portion, and a pivot pin extending from the main body in the first direction; and a door component configured to be coupled to the door, the door component comprising a body defining a pivot pin aperture configured to receive the pivot pin, at least a portion of the body configured to be positioned between the main body of the frame component and the security tab of the frame component when the frame component and the door component are in a closed position;

wherein the frame component and the door component are configurable in a first configuration wherein the frame component is coupled to a first side of the frame assembly and a second configuration wherein the frame component is coupled to a second side of the frame assembly;

wherein the pivot pin is offset at a distance farther from a front surface of the cabinet frame than the cabinet door when the cabinet door is in a closed position;

wherein the door component is configured to be removable by lifting the door component in the first direction only when the door component is moved a predetermined amount relative to the frame component;

wherein the frame component and the door component are configured to be visible from an exterior of the frame component when the door component is in the closed position; and wherein the security tab prevents removal of the door assembly by lifting the door in the first direction until the door is moved from the closed position at least the predetermined amount.

11. The hinge assembly of claim 10, wherein the frame component is configured to be mounted to a front-facing surface of the frame by way of removeable fasteners extending from an exterior of the cabinet, through the frame component, and into the front facing surface of the frame, such that the removeable fasteners are not accessible for removal when the door component is in the closed position.

12. The hinge assembly of claim 10, wherein the door component comprises a door mounting surface configured to interface with the door when the door component is mounted to the door; the door mounting surface facing a first direction when the door is in the closed position in the first configuration, the door mounting surface facing a second direction opposite the first direction when the door is in the closed position in the second configuration.

13. The hinge assembly of claim 10, wherein the frame component is configured to be mounted to a forward facing surface of the frame and wherein the door component is configured to be mounted to a lateral surface of the door, the lateral surface of the door being generally perpendicular to the forward facing surface of the frame when the door is in the closed position.

14. A cabinet assembly comprising:

a frame;

a door; and a hinge pivotally coupling the door to the frame, the hinge comprising:

a frame component fixedly coupled to the frame;

a door component fixedly coupled to the door and rotatably coupled to the frame component at a pivot axis;

wherein the hinge is reversible between first and second configurations to enable pivotal coupling of the door to opposite sides of the frame;

wherein, in both the first configuration and the second configuration, the door component is removable from the frame component in a vertical direction only when the door is opened at least a predetermined amount relative to the frame;

wherein the door is openable to greater than 180 degrees relative to the frame; and wherein the hinge is visible when the door is in a closed position; and wherein the frame component comprises a main body portion, an extending portion extending upward from the main body portion, and a security tab extending transversely relative to the extending portion, such that the security tab prevents removal of the door by lifting the door in the vertical direction until the door is moved from the closed position at least the predetermined amount.

15. The cabinet assembly of claim 14, wherein the predetermined amount is approximately 35 degrees.

16. The cabinet assembly of claim 14, further comprising a sealing gasket extending proximate the periphery of an inside-facing surface of the door, the sealing gasket providing a continuous seal between the door and the frame when the door is in a closed position relative to the frame.

17. The cabinet assembly of claim 14, wherein the door component comprises a door mounting surface configured to engage the door, and wherein the frame component comprises a frame mounting surface configured to engage the frame, the frame mounting surface extending substantially perpendicular to the door mounting surface of the door component when the door is in a closed position relative to the frame.

* * * * *